United States Patent [19]

Rogers

[11] 3,988,082

[45] Oct. 26, 1976

[54] ROTARY STEAM ENGINE

[76] Inventor: Paul Rogers, 451 SW. Primrose, Portland, Oreg. 97219

[22] Filed: Jan. 13, 1975

[21] Appl. No.: 540,576

Related U.S. Application Data

[63] Continuation-in-part of Ser. No. 449,031, March 7, 1974, abandoned.

[52] U.S. Cl. ..... 418/244

[51] Int. Cl.[2] ..... F01C 1/00

[58] Field of Search ..... 251/248; 418/244, 248

[56] References Cited

UNITED STATES PATENTS

| | | | |
|---|---|---|---|
| 730,543 | 6/1903 | Knight | 251/249 |
| 882,360 | 3/1908 | Vincent | 418/248 |
| 2,055,137 | 9/1936 | Sherman | 418/244 X |
| 3,724,975 | 4/1973 | Bschorer | 251/249 X |
| 3,771,500 | 11/1973 | Shakiba | 123/8.49 X |

FOREIGN PATENTS OR APPLICATIONS

| | | | |
|---|---|---|---|
| 635,754 | 9/1936 | Germany | 123/8.45 |

*Primary Examiner*—Carlton R. Croyle
*Assistant Examiner*—Michael Koczo, Jr.
*Attorney, Agent, or Firm*—Oliver D. Olson

[57] ABSTRACT

A tubular housing having a circular inner surface provided with a plurality of recesses for receiving pistons movable pivotally between a position fully retracted in said recesses and a position projecting radially inward from the housing. A rotor is supported centrally in the housing for axial rotation and has peripheral cavities equal in number to the number of pistons in the housing and capable of receiving the pistons at predetermined intervals of rotor rotation to perform with the pistons the functions of steam intake, steam expansion and exhaust. The housing has steam intake ports and exhaust outlet ports operable in conjunction with the rotor and pistons to perform the engine functions. The pistons are moved inwardly into the cavities during certain operations of the engine by levers operatively connected to the rotor.

3 Claims, 12 Drawing Figures

FIG. 4
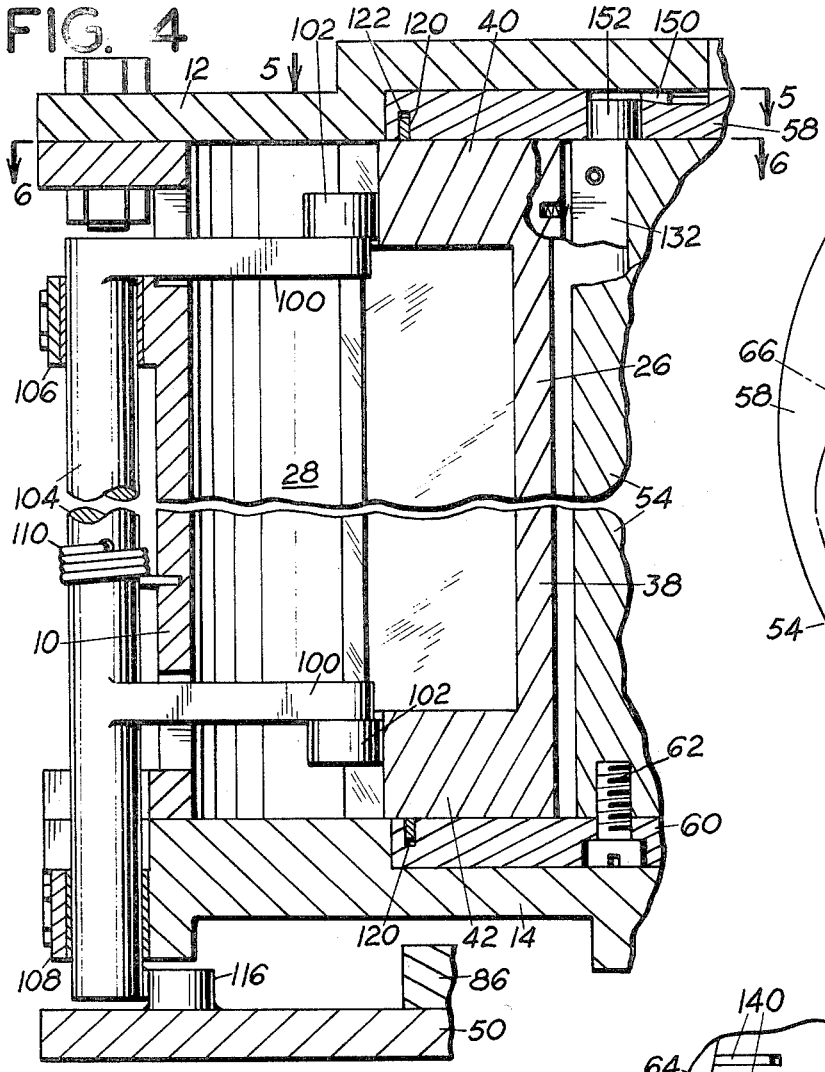
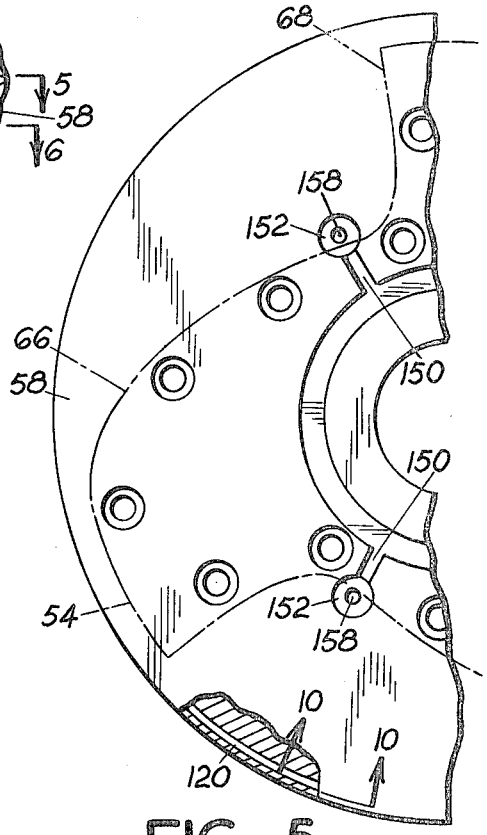
FIG. 5
FIG. 6
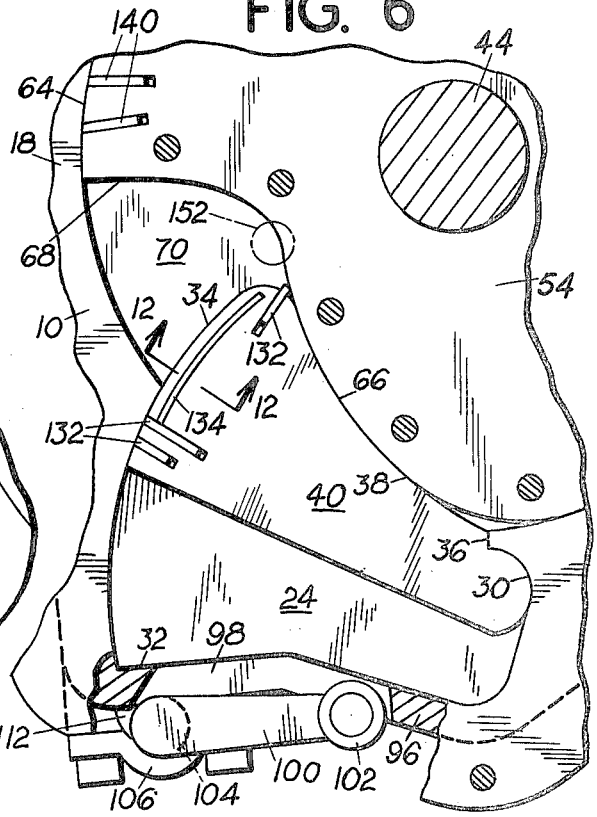
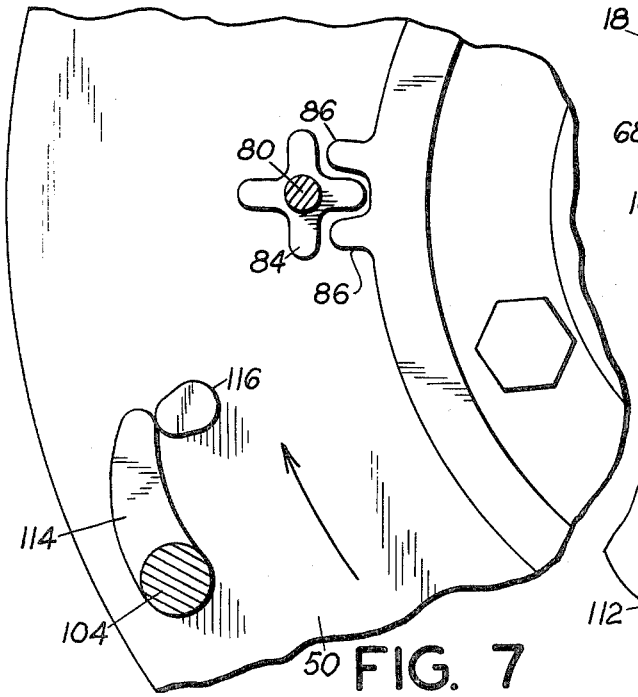
FIG. 7

ROTARY STEAM ENGINE

CROSS REFERENCE TO RELATED APPLICATION

This is a continuation-in-part of my earlier application Ser. No. 449,031, filed Mar. 7, 1974, and now abandoned.

BACKGROUND OF THE INVENTION

This invention relates to new and useful improvements in rotary steam engines.

Rotary steam engines have been proposed heretofore in an attempt to produce a more efficient source of power than the piston type engine which is rendered inefficient by the requirement to convert reciprocating motion to rotary motion. Such prior rotary engines have utilized vane type structures or the like that require a great number of moving parts to provide the required chambers for steam intake, expansion and exhaust, thereby contributing to excessive cost of manufacture, maintenance and repair.

SUMMARY OF THE INVENTION

In its basic concept, the rotary steam engine of this invention utilizes pistons disposed in recesses in an outer circular housing and are arranged to move into and out of cavities in a central rotor in a timed sequence, the number of moving parts being minimized to reduce correspondingly the cost of manufacture, maintenance and repair.

A more particular objects of this invention is to provide a rotary steam engine of the class described wherein the pistons have pivotal support in the recesses in the housing and are operative to pivot in and out relative to the rotor cavities to accomplish the functions to steam intake, expansion and exhaust.

Another object of this invention is to provide a rotary steam engine of the class described in which the pistons are associated with levers pivotally mounted on the housing and arranged by driving engagement with an output from the rotor to move the pistons inwardly at timed intervals to effect the engine functions, the levers holding the pistons in the cavities during steam expansion, whereby the pistons form a solid brace for said expansion.

The invention will be better understood and additional objects and advantages will become apparent from the following description taken in connection with the accompanying drawings of a preferred embodiment.

BRIEF DESCRIPTION OF THE DRAWINGS

FIG. 4 is a fragmentary foreshortened sectional view taken on the line 4—4 in FIG. 2.

FIG. 5 is a fragmentary sectional view taken on the line 5—5 in FIG. 4.

FIG. 6 is a fragmentary sectional view taken on the line 6—6 in FIG. 4.

FIG. 7 is a fragmentary sectional view taken on the line 7—7 in FIG. 3.

DESCRIPTION OF THE PREFERRED EMBODIMENT

Figure 1:
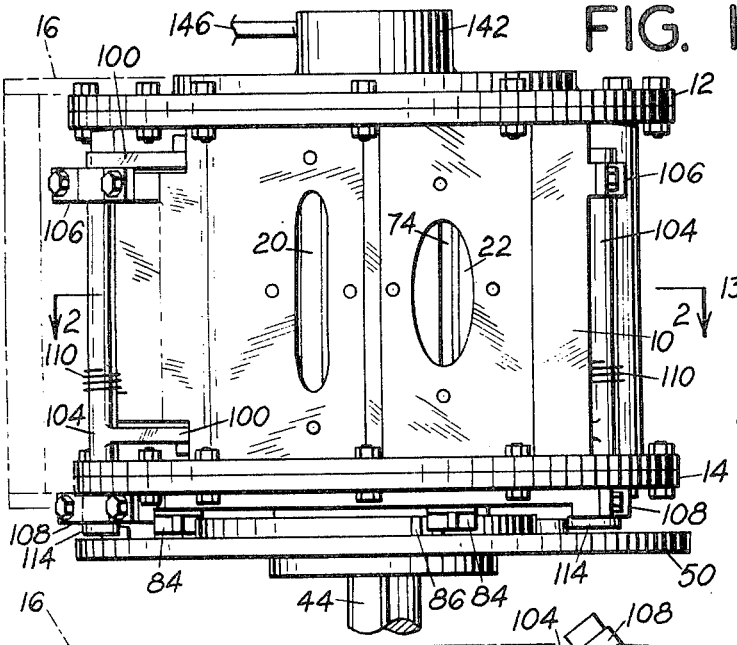
FIG. 1 is a view in side elevation of a rotary steam engine embodying the features of this invention.

With particular reference to FIGS. 1–4 of the drawings, the rotary steam engine includes a tubular housing 10, an upper cover 12 and a lower cover 14. Although these components are illustrated as single piece units, it will be understood that they may be provided as circular segments interconnected by such means as bolted flanges. A mounting bracket 16 may be provided to support the engine.

The housing has a plurality of circumferentially spaced circular inner wall surfaces 18 (there being three illustrated) and a plurality of pairs of steam inlet ports 20 and exhaust ports 22 registering with said surfaces 18 and suitably coupled to inlet and exhaust manifolds (not shown). Between the spaced surfaces 18 the housing is recessed outwardly to provide cavities 24 for pistons 26.

The cavities 24 have opposite end wall surfaces that extend somewhat radially of the housing. The end wall 28 is gently concaved throughout its length, while the opposite wall has an inner end projection 30 provided with a curved surface on its side that faces the exterior of the housing. Each cavity has a depth to allow full retraction of the piston therein and has an outer wall portion 32 against which a portion of the piston is arranged to abut in its retracted position.

Each piston extends fully from top to bottom of its cavity. It has a convex front face 34 of a radius identical to the curvature of the end surface 28 of the recess. The other or rearward end of the piston is rounded and has a radius of curvature identical to that of the curved portion 30 of the recess so that the piston can pivot into and out of the recess. In such pivotal movement the front surface of the piston slides freely along and closely adjacent to recess surface 28. An offset edge 36 is provided at the inner portion of the piston end and this edge has abutment against the end of the projection 30 in the fully extended position of the piston.

The side surface 38 of each piston that faces inwardly has a concave curvature the same radius as surface 18. The piston has top and bottom end walls 40 and 42 with straight edges and define with the surface 38 a cavity which reduces the weight of the piston.

A shaft 44 projects centrally through the housing, being journaled in upper thrust bearing 146 mounted in the upper cover and in lower bearing 48 mounted in the lower cover. The projecting lower end of the shaft is adaptable for connection to means to be driven, such as a transmission, not shown, and it also mounts a combination fly wheel and starter gear 50 secured thereto as by a key connection 52.

Disposed centrally within the housing is a rotor 54 secured to the shaft 44 as by key 56. The rotor has a contoured peripheral surface and top and bottom walls 58 and 60, respectively, secured to the ends of the rotor as by screws 62.

The rotor extends the full height of the housing section and its upper and lower end walls are disposed in recesses in the upper and lower covers 12 and 14. The end walls receive the shaft centrally and their diameters are such that their outer peripheral edges are radially outward of the inner wall surface of the housing 10.

The peripheral wall of the rotor has a plurality of circumferentially spaced circular surfaces 64 and cooperates with the inner wall of the housing to define a plurality of recesses therein equal in number to the number of piston cavities 24 in the housing 10. Each of the recesses has a first wall portion 66 that curves inwardly from the surface 64 at a radius identical to the radius of curvature of the side 38 of the piston, whereby the surface 38 is adapted to have matching engagement throughout substantially its full length with the recess surface 66. The latter surface joins at its forward end with an outwardly extending curved surface 68 which forms the driving surface on the rotor. The space between the surfaces 68 and 34 constitutes the rotor chamber 70 into which steam is to be introduced to provide the power function.

Means is provided for metering steam under pressure into the rotor chambers 70 on a timed sequence. This is provided in the embodiment illustrated by a vertically elongated valve rod 72 having an elongated slot 74 therethrough, the rod being provided with enlarged ends 76 journaled for rotation in bearings 78 in the housing. The bottom enlarged end secures a projecting shaft 80 for rotation therewith, as by means of a connecting pin 82, and the outer end of the shaft mounts a star wheel 84 (FIG. 7). A pair of spaced projections 86 on the starter gear 50 are disposed for engagement with the star wheel during rotation of the starter gear, to effect intermittent rotation of each valve rod 72 through 90° intervals for momentary communication of the slot 74 with the associated one of the inlet steam ports 20, thereby communicating the source of steam under pressure momentarily with the rotor chambers 70.

Stepwise rotation of the valve rod through 90° intervals is insured by the provision of detent pockets 88 (FIG. 8) disposed at 90° intervals in the enlarged end portions of each rod for reception of detent ball 90 mounted in an opening in the housing and spring loaded by means of compression spring 92 interposed between the ball and an adjustable set screw 94.

In certain phases of operation of the engine, as will be more apparent hereinafter, it is necessary that the piston be driven inwardly into the chambers 70. For this purpose each of the outer defining walls 96 of the housing cavities 24 has an opening 98 and a pair of lever arms 100 project through these openings and have engagement with the outer edges of the side walls 40 and 42 (FIG. 4) of the pistons. Engagement of the lever arms with the piston is by means of rollers 102 on the inner ends of the arms. Each pair of lever arms extends integrally from an upright shaft 104 having journaled support in upper and lower bearings 106 and 108 secured respectively to the exterior surface of the housing 10 and the lower cover 14. These shafts are urged clockwise, as viewed in FIGS. 2 and 6, by a torsion spring 110 having one end secured to the shaft and the other end secured to the housing. The shafts are normally rotatable under the action of the spring to a retracted position of the arms wherein the pistons are capable of moving into their cavities in the housing. A stop 112 (FIG. 6) integral with each shaft is arranged to abut against the housing 10 to limit rotation of the shafts under the action of the springs.

Each of the shafts 104 has an actuating finger 114, FIG. 7, at the lower end thereof in the path of a plurality of projections 116 on the top surface of the fly wheel 50 and the arrangement is such that as the projections engage the actuating fingers the shafts and consequently the arms 104 are driven counterclockwise (FIG. 2) momentarily to move the pistons 26 into the rotor chambers. The actuating fingers 114 have rounded ends which abut the projections to smoothly move the lever arms into the chambers. The projections also are rounded at their points of engagement by the fingers to minimize wear and shock to the parts.

Figure 10:
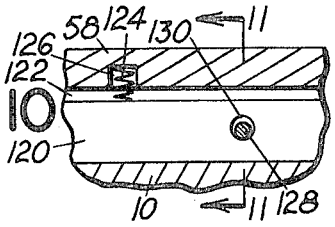
FIG. 10 is a fragmentary sectional view taken on the line 10—10 in FIG. 5.
Figure 11:
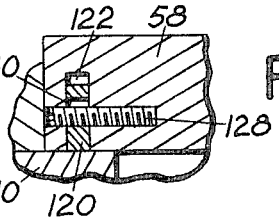
FIG. 11 is a fragmentary sectional view taken on the line 11—11 in FIG. 10.
Figure 12:
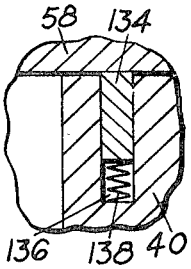
FIG. 12 is a fragmentary sectional view taken on the line 12—12 in FIG. 6.

Sealing means for containing the power is provided throughout the engine. First, the upper and lower end walls 58 and 60 of the rotor have an annular sealing member 120 which faces and engages adjacent surfaces of the housing and pistons. These sealing members are shown in detail in FIGS. 10 and 11 and comprise blade-like structures confined movably in slots 122 in the rotor. These slots are deeper than the parallel dimension of the sealing members and a plurality of small compression springs 124 confined partly in recesses 126 in the end walls of the rotor urge the sealing members outwardly. The slots being of greater dimension than the parallel dimension of the seals allow the latter to float therein under the force of springs whereby to adjust automatically for wear and irregular surfaces. Sealing members are confined in the slots by cross pins 128 threadedly supported in place and passing through apertures 130 in the sealing members. The apertures are enlarged relative to the pins to allow floating movement of the sealing members.

Each of the pistons also has vertical sealing member 132 (FIG. 2) projecting from the surfaces. The sealing members are similar to the sealing members 120, have floating outward bias movement in deepened slots throughout the action of springs. These sealing members are held in place by retaining pins projecting through enlarged apertures in the sealing members.

Further, the top and bottom surfaces of the pistons are provided with radially extending sealing member 134 similarly confined in deepened slots 136 and urged outwardly by springs 138 (FIG. 13). These sealing members extend longitudinally between the sealing member and a point closely adjacent the inner side of the piston.

Figure 2:
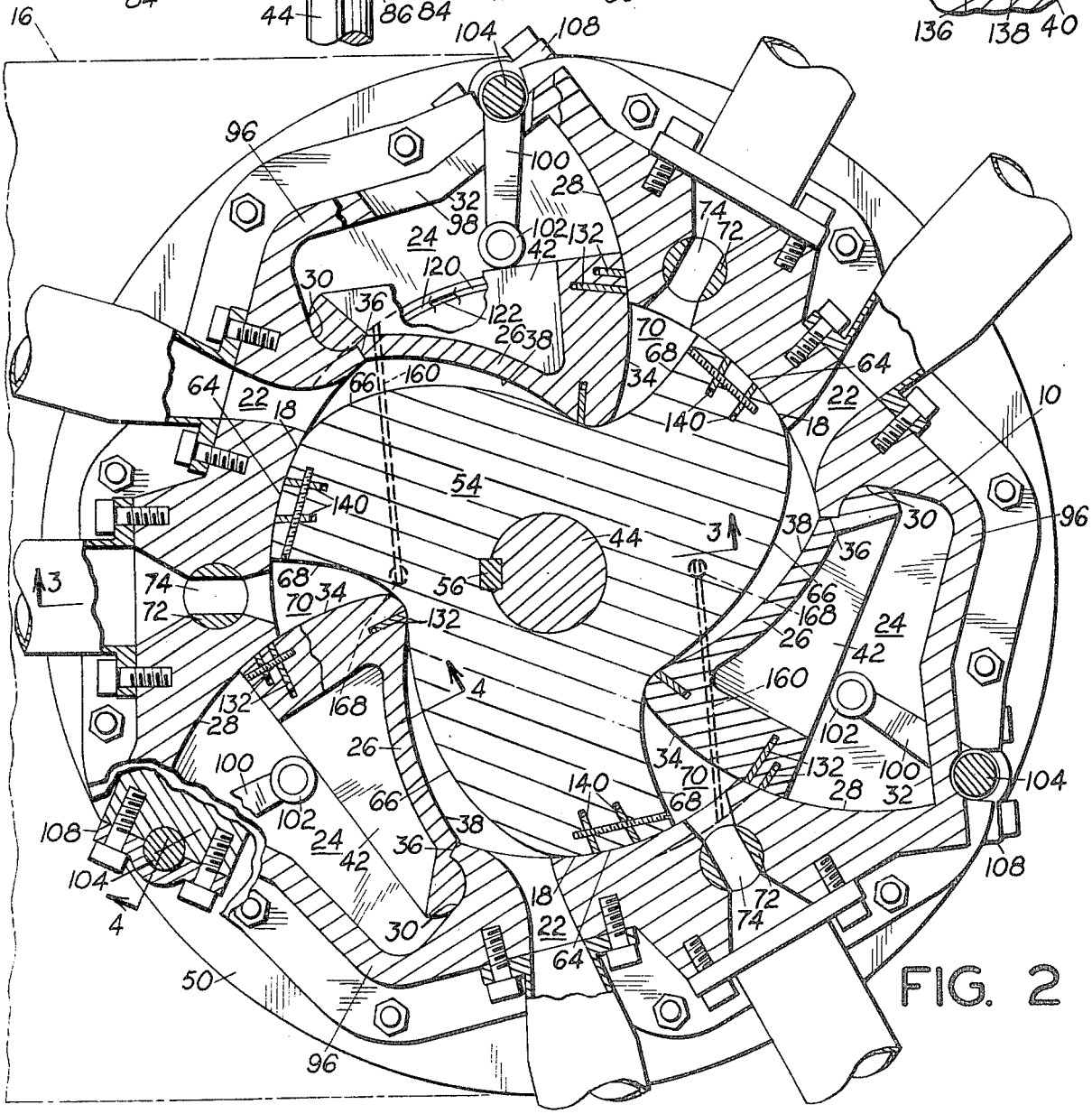
FIG. 2 is a sectional view taken on the line 2—2 in FIG. 1.

With reference to FIG. 2, the rotor 54 has vertical sealing members 140 in the circular section 64. These sealing members have floating engagement in deepened slots similar to the other sealing members previously described.

Lubrication means are provided for lubricating those surfaces areas that have wearing engagement, and for this purpose an oil inlet cup portion 142 of the top cover 12 has a port 144 communicating with an oil inlet conduit 146 from a suitable source of pressurized lubricating oil (not shown). The port has communication with bearing 46 and oil passes down through this bearing to the top surface of the rotor wall 58. From there the oil seeps along between this wall and the upper wall 12 of the housing and then down the vertical outer defining edge of the rotor wall and also down to the horizontal overlapping portion of the wall and the housing and pistons, for lubricating these relatively moving parts.

The walls of the chambers 70 are also lubricated, and for this purpose the upper surface of wall 58 is provided with an annular channel 148 which picks up oil from the flow along the top surface of the wall. Radially extending channels 150 lead from the channel 148 to each chamber at about the juncture of the surfaces 66 and 68 of the chambers. Disposed at the ends of the channels are oil feed inserts 152 (FIGS. 3 and 9) set in the wall 58 and having inner chambers 154 in which a ball valve 156 is confined and arranged for engagement with upper and lower seats. The inserts have upper and lower ports 158 communicating with the chambers from the seats, and as best seen in FIG. 5, the ports 158 are located just outwardly of the surface 66 of the chambers whereby oil moving through the insert was served to lubricate the surfaces of the chambers.

In the operation of the inserts, oil flows thereto by centrifugal force and fills the chambers 154, the ball valves 156 resting by gravity on the lower seat to stop downward oil flow. When a power stroke occurs in the engine and since the lower port is aligned with a chamber, there is sufficient pressure to raise the ball valves and allow a small amount of oil to escape through the valve to the chamber wall surfaces. During this power function the ball valves raise up against the upper seat to prevent escape of power but seal immediately upon termination of the power function.

Figures 3, 8, 9:
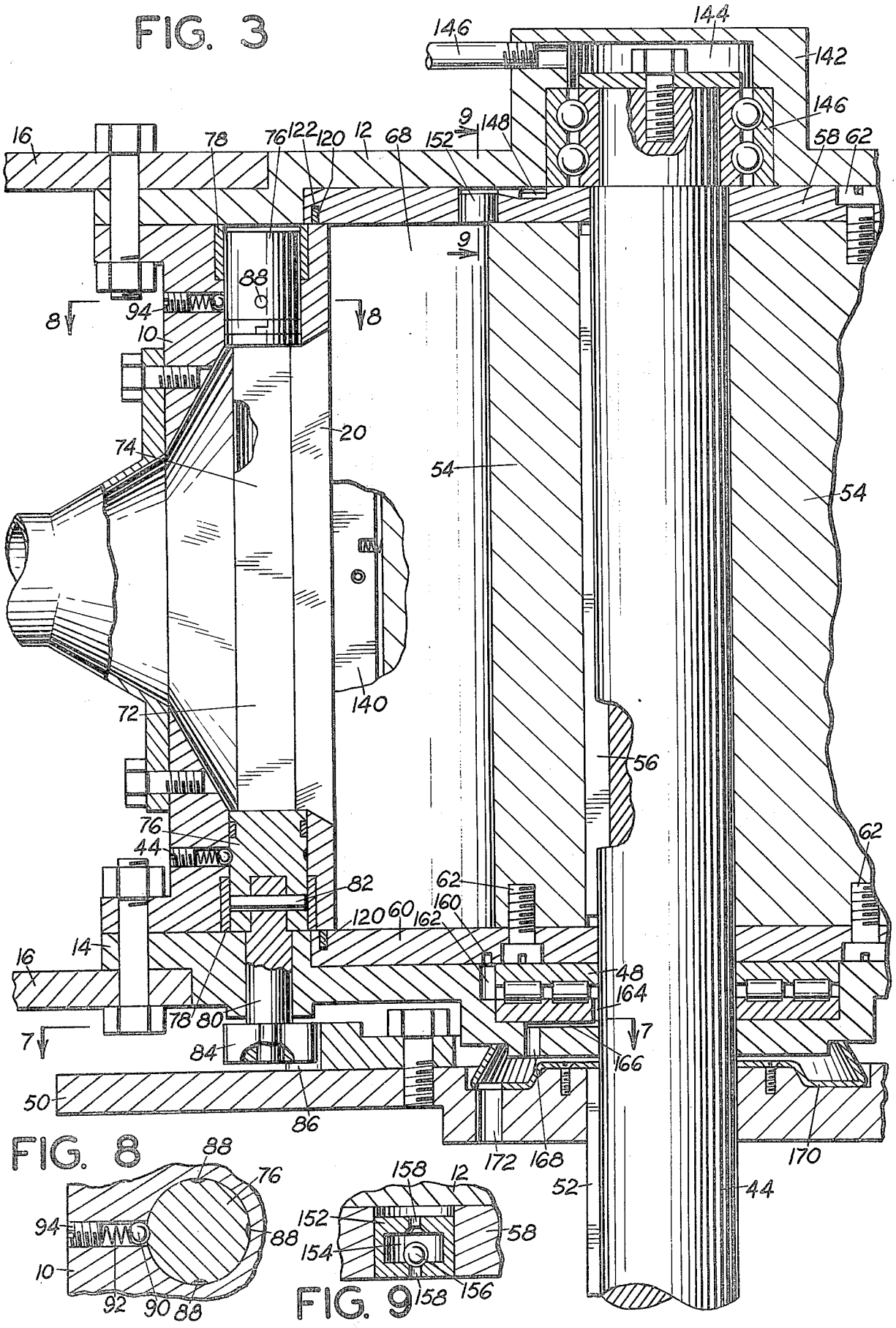
FIG. 3 is a fragmentary sectional view taken on the line 3—3 in FIG. 2.
FIG. 8 is a fragmentary sectional view taken on the line 8—8 in FIG. 3.
FIG. 9 is a fragmentary sectional view taken on the line 9—9 in FIG. 3.

With reference to FIGS. 2 and 3, the lower surface of the bottom wall 60 of the rotor has a pair of channels 160 extending somewhat tangentially to the hub portion but spaced therefrom for taking up oil that has seeped down between the outer edge of the wall 60 and the lower wall 14 of the housing. The inner ends of these channels communicate with ports 162 leading to the bearing 48. This bearing is provided with an inner annular passageway 164 through which oil in the bearing escapes and this passageway communicates with channels 166 in a washer inset in the bottom cover. The channels have communication by means of a space 168 therearound with an oil pickup pan 170 secured to the flywheel 50 between the bottom cover and the flywheel. Discharge of the oil from the pan to a sump or reservoir is by ports 172 in the pan and flywheel. The channels 160 being somewhat tangential to the rotor rather than radial, sweep angularly around the bottom defining wall 60 of the rotor and pick up oil from the surface and direct it into the ports. The lubricating means described provides lubrication in the areas between all the relatively moving surfaces to provide long life for the engine.

For the purpose of explaining the operation in functions of steam intake, expansion and exhaust, reference is made to FIG. 2 wherein the direction of rotation of the rotor is clockwise. In the illustrated position of the rotor all three of the pistons 26 are moved to the inwardmost position by momentary engagement of the projections 116 on the flywheel with the actuating fingers 114 of the associated shafts 104 and lever arms 100. Also at this time the star wheels 84 will have been engaged by the leading projections 86 on the flywheel to rotate the valves 72 through 90° to the open positions illustrated in FIG. 2, whereby to admit steam under pressure into the chambers 70 defined between the wall portions 68 and 34 of the rotor and confronting surfaces of the pistons. The expanding steam thus directs its force against the wall portions 68 of the rotor and thus causes the latter to rotate clockwise. Continued rotation of the flywheel causes the trailing projections 86 to rotate the star wheels 84 and valves 72 another 90° to close the valve slots 74.

During clockwise rotation of the rotor, the wall portion 68 ultimately passes the associated exhaust port 22. The steam expansion chamber thus is exhausted to the atmosphere and ultimately completely scavenged by the wiping action which occurs as the arcuate portion 66 of the rotor laps along the inner surface 38 of the piston as the latter is caused to retract freely because of release of the momentary engagement of the lever arm 100.

During this radially outward retracting movement of the piston 26, subsequent to the position illustrated in FIG. 6, both ends of the piston retract into cavity 24, insuring maintenance of a positive seal between the piston seal 132 and rotor chamber wall 66 during expansion of the steam. As the piston approaches full retraction, the radially outward edges of its walls 40 and 42 abut the rearward portion of the outer angular surface 32 of the cavity 24 and the piston is caused to pivot counterclockwise (FIG. 2) about the central portion of the angular surface 32 to swing the rearward end of the piston radially inward into the curved surface 30 of the cavity 24. The forward portion of the piston then completes its retraction into the cavity by forward rotation of the rotor, until the inner arcuate surface 38 of the piston lies in the circular plane of the inner surface 18 of the housing 10.

In the embodiment illustrated, there are three pistons associated with three cavities and chambers. Thus, since each chamber performs a steam expansion function, there are nine such expansion functions occurring during each revolution of the rotor. This arrangement is exemplary only, and it will be understood that any number of pistons and associated cavities and chambers may be provided.

To illustrate the foregoing basic arrangement, a rotary steam engine of the type described having a rotor height of 8 inches and a diameter of 24 inches with nine chambers each 2¼ inches deep and operated at 100 revolutions per minute with an average chamber steam pressure of 75 pounds per square inch, the resultant output of the engine is about 340 horse power.

The rotary steam engine of this invention is constructed of a minimum number of parts, whereby to minimize the cost of manufacture, maintenance and repair. It may be constructed in a wide variety of sizes for a diversity of uses. Further, maximum efficiency of operation is derived from the fact that the expansion of steam is in a direction substantially tangential to the rotation of the rotor, i.e. against the portion 68 of the peripheral surface of the rotor 54.

It will be understood that the form of my invention herein shown and described is to be taken as a preferred example of the same and that various changes in the shape, size, type, number and arrangement of parts may be resorted to without departing from the spirit of this invention, or the scope of the subjoined claims.

Having thus described my invention, I claim:

1. A rotary steam engine comprising:

a. a tubular stationary housing, b. the inner surface of the housing having the plurality of circumferentially spaced cavities therein, c. a rotor in said housing having an outer surface rotatable closely adjacent said inner surface of said housing, d. said outer surface of the rotor having a plurality of circumferentially spaced rotor chammbers therein each registrable with each cavity in the housing during rotation of the rotor, e. a piston in each cavity movable between a position fully retracted into said cavity and a position projecting radially inward into a registering rotor chamber, f. timed steam inlet means and steam exhaust means in the housing intermediate adjacent cavities operative respectively to inject steam into and exhaust steam from each rotor chamber during rotation of the rotor, g. output means connected to said rotor for rotation therewith, and h. timed piston drive means associated with each piston and operable to move the associated piston inwardly into a registering rotor chamber preliminary to injection of steam under pressure into said rotor chamber ahead of said piston to effect rotation of the rotor, the timed piston drive means including driven means connected to and rotatable with said output means exteriorly of said housing, a lever associated with each piston pivotally mounted intermediate its ends on said housing and having one end thereof disposed for abutting engagement with said piston on the side of the latter opposite the rotor, said lever being pivotally movable between an outer retracted position allowing said piston to retract to its cavity and an inner position moving said piston from its cavity into a registering rotor chamber, and a projection on said driven means arranged to engage the other end of said lever so as to rotate said lever to its position of moving said piston from its cavity into a registering rotor chamber.

2. A rotary steam engine comprising:

a. a tubular stationary housing, b. the inner surface of the housing having a plurality of circumferentially spaced cavities therein, c. a rotor in said housing having an outer surface rotatable closely adjacent said inner surface of said housing, d. said outer surface of the rotor having a plurality of circumferentially spaced rotor chambers therein each registrable with each cavity in the housing during rotation of the rotor, each chamber having a forward driving surface extending inwardly from the outer surface of the rotor and a trailing surface extending rearwardly from the inner edge of the forward driving surface of the outer surface of the rotor, e. a piston in each cavity movable freely at both of its ends radially between a position fully retracted into its cavity and a position projecting radially inward into a registering rotor chamber, each piston having a front face arranged in sealed, sliding engagement with the front surface of its cavity, the front face of the piston associated with one of the cavities defining with the forward driving surface of a registering rotor chamber, when the piston is projected thereinto, a steam expansion chamber registering with the associated steam inlet, and each piston having an inner surface which, when the piston is projected into a rotor chamber, is disposed at least at its forward end in sealed, sliding engagement with the trailing surface of said chamber throughout the steam-expansion portion of the operating cycle of the engine, f. timed steam inlet means in the housing adjacent the leading end of each piston cavity, and steam exhaust means in the housing adjacent the trailing end of each piston cavity, the inlet and exhaust means being operative respectively to inject steam into and exhaust steam from each rotor chamber during rotation of the rotor, g. timed piston drive means associated with each piston and operable momentarily to move the associated piston inwardly into a registering rotor chamber preliminary to injection of steam under pressure into said rotor chamber ahead of said piston to effect rotation of the rotor, and thereafter to allow free outward movement of the piston at both of its ends into said housing cavity, and h. output means connected to said rotor for rotation therewith.

3. The rotary steam engine of claim 2 wherein each timed steam inlet means includes a steam inlet port, a ported rod associated with each inlet port mounted in the housing for axial rotation for selectively opening and closing the inlet port, a star wheel projecting from the valve rod, and an abutment rotatable with the rotor and arranged to engage the star wheel and rotate it stepwise in 90° intervals in timed sequence for admitting steam under pressure momentarily into the rotor chamber during the steam expansion function.

* * * * *